United States Patent [19]

Diemer et al.

[11] 4,196,367

[45] Apr. 1, 1980

[54] X-RAY TUBE

[75] Inventors: Willem H. Diemer; Gerrit Zwep, both of Eindhoven, Netherlands

[73] Assignee: U.S. Philips Corporation, New York, N.Y.

[21] Appl. No.: 895,936

[22] Filed: Apr. 13, 1978

[30] Foreign Application Priority Data

Apr. 25, 1977 [NL] Netherlands ..... 7704473

[51] Int. Cl.[2] ..... H01J 35/14

[52] U.S. Cl. ..... 313/59; 313/555

[58] Field of Search ..... 313/59, 55

[56] References Cited

U.S. PATENT DOCUMENTS 2,407,857 9/1946 Verhoeff ..... 313/59 X 3,835,341 9/1974 Zingaro ..... 313/59

3,892,989 7/1975 Gralenski et al. ..... 313/59

*Primary Examiner*—James B. Mullins

*Assistant Examiner*—Darwin R. Hostetter

*Attorney, Agent, or Firm*—Algy Tamoshunas

[57] ABSTRACT

Disclosed is an X-ray tube for fluorescence analysis having an exit aperture which is closed by a window of non-uniform thickness. A thicker window portion is located at the side of the aperture remote from the anode and partly overlaps a thinner window plate. In an analysis apparatus, the thicker window portion is located in a portion of the window through which passes the radiation traversing a comparatively small distance between the anode and the specimen.

9 Claims, 3 Drawing Figures

X-RAY TUBE

Figure 1:
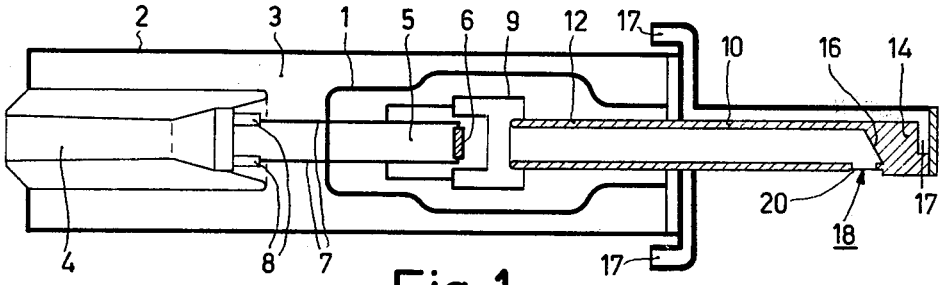

The invention relates to an X-ray tube, comprising an envelope which is provided with an exit window and which accommodates a cathode and an anode for generating an X-ray beam.

An X-ray source of this kind is known from British Patent Specification No. 1,225,405. An X-ray tube described therein is provided with a comparatively thin window which is preferably made of beryllium. Intense heating of the window material can occur in these tubes due to electrons and X-rays incident thereon. When the window is made to be thicker in order to achieve an adequate service life, an excessive part of notably comparatively soft X-radiation is absorbed, so that the tube is inefficient for this radiation range. The described X-ray tube also includes a magnetic deflection mechanism for deflecting secondary electrons, reflected from the anode and emitted thereby, so that they do not reach the exit window. A magnetic shielding system of this kind, however, is comparatively expensive and requires substantial space in the vicinity of the window where space is usually not available. Furthermore, this form of shielding is not effective for X-rays.

It is to be noted that U.S. Pat. No. 3,835,341 describes an X-ray tube which comprises two windows which can be used at the option of the operator. To this end, the windows can be shifted with respect to the anode by means of a bellows connection. Such a movement mechanism is comparatively complex and does not offer additional protection of the exit window for each of the positions.

The object of the invention is to provide an X-ray tube capable of performing measurements over a wide wavelength range, without the necessity for window adjustment and without excessive heating of the window material. To this end, in accordance with the invention an X-ray tube of the kind described is characterized in that the exit window has a non-uniform transmissivity or transmission to X-ray radiation.

As a result of the non-uniform transmission of the exit window, an X-ray tube in accordance with the invention has a high radiation efficiency over a wide wavelength spectrum, because comparatively soft radiation can emerge via a thinner window portion while harder radiation also passes through the thicker window portion.

In one embodiment of the invention, the exit window is composed of a window plate of non-uniform thickness.

In another embodiment, the exit window comprises a stack of two window plates, each having a uniform thickness. The thinner window plate provides vacuum sealing of the tube while the thicker window plate extends over only part of the window aperture.

The comparatively thick window portion is located in a portion of the window aperture which is remote from the anode target, viewed in the X-ray tube.

In an X-ray fluorescence apparatus comprising an X-ray tube in accordance with the invention, the thicker window portion is positioned in the window aperture so that the irradiation of a specimen to be examined is as uniform as possible. This is achieved by arranging the thicker window plate at the area where the window is comparatively near to the specimen.

Figure 2:
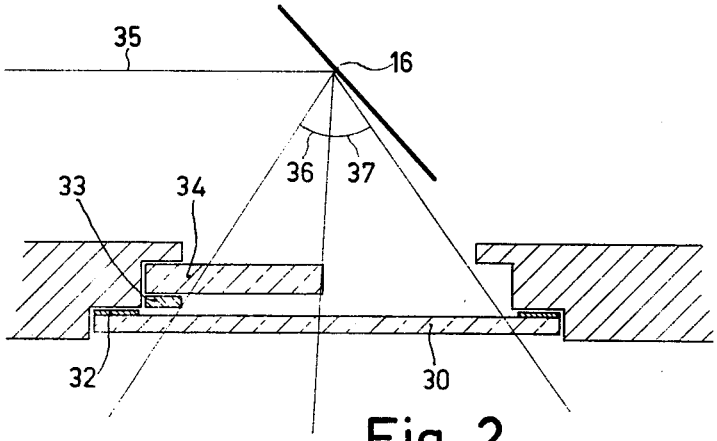
Figure 3:
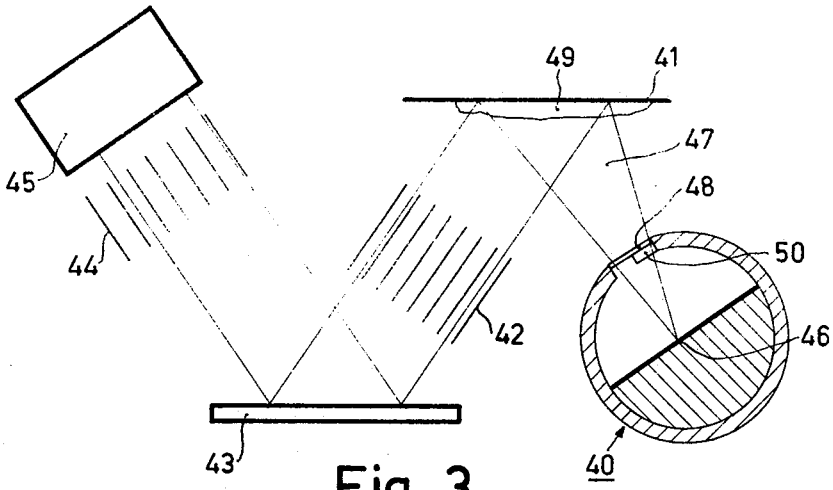

Some preferred embodiments of X-ray tubes in accordance with the invention will be described in detail hereinafter with reference to the accompanying diagrammatic drawing in which:

FIG. 1 shows an X-ray fluorescence analysis tube in accordance with the invention, FIG. 2 is a more detailed view of an exit window of such a tube, and FIG. 3 shows an X-ray fluorescence analysis device, comprising an X-ray tube in accordance with the invention.

The X-ray tube shown in FIG. 1 comprises a preferably glass envelope 1 and a housing 2 disposed about the envelope, which in this case encloses an oil-filled space 3. The housing has an inlet opening 4 for a high voltage plug and filament connections for a cathode 5 accommodated in the housing. The cathode comprises an emissive element 6 which can be heated via supply leads 7 connected to contact pins 8. Provided around the cathode is a shielding sleeve 9. The emissive element may be a filament coil or, alternatively may also be constructed as an indirectly heated element as described in U. S. Pat. No. 3,497,757. Because it is desirable to have a small anode target spot and a high current density in the electron beam of the X-ray tube, it is extremely advantageous to use a storage cathode in which an electron emissive substance, such as barium oxide, is contained in a space which is closed on a side facing the anode by a porous cover plate which is preferably impregnated with osmium. Thus, a comparatively high emission current density and a long service life can be combined without evaporation or sputtering of the cathode material. Moreover, the electron optical system in the tube can be optimized by the more accurate geometry of the cathode and the emissive surface thereof. Opposite the cathode there is arranged an anode sleeve 10 having a cylindrical portion 12 which extends to the vicinity of the cathode. The end of the anode sleeve opposite the cathode is closed by an anode body 14 provided with an anode target 16.

The anode can be cooled by a liquid circulating through duct 17. The anode target may form part of the anode body which is made for example, of copper, but the target may alternatively be provided as a separate plate on or in the anode body. A target of this kinds consists, for example, of tungsten, chromium, molybdenum, silver, gold or rhodium, depending on the desired radiation. In the described X-ray tube, the anode target is made of rhodium in which soft L $\alpha$ radiation as well as harder K $\alpha$ radiation can be generated, depending on the applied acceleration voltage of the electron beam. As a result, this X-ray tube is suitable for the analysis of elements having substantially different atomic numbers. An additional advantage is that rhodium only rarely occurs in specimens to be analyzed.

Near the anode target, the anode sleeve is provided with a radiation aperture 18 which is closed by a window 20. In known X-ray tubes, the window has a diameter of, for example, approximately 15 mm and a thickness of, for example, from 0.25 to 1.0 mm, depending on the hardness of the radiation to be generated. In accordance with the invention, the window has a non-uniform thickness, for example, as shown in a preferred embodiment in FIG. 2. The window aperture 18 is sealed in a vacuumtight manner by means of a beryllium disk 30. This window plate is mounted in the window aperture by a sealing diffusion ring 32. The beryllium disk has a thickness of, for example, 0.15 mm and a diameter of, for example, 15 mm. An intermediate mounting ring 33 is used for mounting a second beryllium disk 34 in the window aperture. Disk 34 has the shape of a semi-circle and is arranged on the side of the window aperture which is remote from the anode target 16. The second window plate 34, which in this case is also made of beryllium, has a thickness of, for example, from 0.5 to 1.0 mm. Alternatively, plate 34 may be made of aluminium or titanium of a thickness adapted to the absorption of these materials. Plate 34 is mounted on the inner side of the sealing window plate 30. A portion 36 of an X-ray beam generated by an electron beam 35 will pass through the thicker window portion and the portion 37 will pass through the thinner window portion. When comparatively soft radiation is generated, substantially only the thin window portion acts as an exit window, while in the case of comparatively hard radiation, this function is performed by the entire window.

Electrons released in and reflected by the target spot will, due to the geometry, move mainly in the direction of the thick window plate where they are intercepted. Because this window plate is thick, the heat developed therein can be more readily dissipated and, moreover, a higher degree of destruction of this window plate is permissible, because it does not have a vacuum sealing function. A further improvement can be effected by making the window plate 34 completely or partly of a material having a better heat conductivity or a higher heat capacity. Moreover, in order to improve the vacuum-tightness, the thinner window plate may be made of beryllium covered with titanium. A titanium cover of a few microns already provides proper vacuum-tightness.

The window plate 34 may alternatively be constructed of a different shape, for example, the shape of a sickle, or use can be made of a plate which extends completely around the circumference and has an aperture at the area of the desired thin window. The heat dissipation to the window support can be improved by such configurations.

The window of a further preferred embodiment has a single plate with a thinner portion effected by local removal or omission of window plate material. Such a construction is particularly advantageous for window plates formed by sintering of window plate material, because a prefabricated matrix of the desired profile can be used during sintering. Thicker and thinner window plate portions can then also gradually change over one into the other, if desired, and it is also comparatively easy to form a window plate having a ring of uniform thickness along its entire circumference for mounting in the window aperture.

In order to reduce the presence of stray radiation in the X-ray beam emitted by the X-ray tube, relevant parts of the anode sleeve, and possibly the anode body, are preferably covered with or made from a light material, such as aluminium; material in accordance with Netherlands Patent Application No. 7704474 filed simultaneously with the present application by applicant, which corresponds to U.S. application Ser. No. 893,950, filed on Apr. 6, 1978 and assigned to the assignee of the present application.

The X-ray fluorescence apparatus diagrammatically shown in FIG. 3 comprises an X-ray tube 40, in this case shown in a cross-sectional view through the exit window, a specimen holder 41, a first collimator 42, an analysis crystal 43, a second collimator 44, and a detection device 45. An X-ray beam 47 originating from an anode target spot 46 is incident, through the exit window 48, on a specimen 49 which is disposed on the specimen holder 41. The distance between the specimen and the anode target spot as measured across the specimen is not constant. In order to achieve an irradiation of the specimen which is as homogeneous as possible, the comparatively thick window portion is preferably located at the area where the radiation emitted travels the shortest distance to the specimen. In the described embodiment, a thicker window plate 50 is shown in that position.

The resolution of such an X-ray fluorescence analysis device is favourably influenced by reduction of the anode target spot in at least on direction. Such a reduction should not be accompanied by a reduction of the radiation intensity and therefore, the current density of the electron beam should be comparatively high. Therefore, the use of an indirectly heated cathode is preferable.

As the electron target spot is made smaller, the influence of movements thereof across the anode will be more disturbing. External magnetic fields, such as the terrestrial magnetic field and magnetic fields originating from electrically driven motors or from a specimen to be measured, may cause such displacements. In a preferred embodiment in accordance with the invention, ferromagnetic material is included in the cathode sleeve 9 and/or the anode sleeve 10 in order to provide shielding against such magnetic fields.

A properly stationary electron target spot can be realized particularly because the ferromagnetic material is provided tightly around the electron beam. Maximum benefit can thus be derived from the improved window construction.

What is claimed is:

1. An X-ray tube comprising an envelope, a cathode and an anode arranged in said envelope for generating an X-ray beam, said envelope having an exit aperture for passing said beam and a window mounted in said aperture, said window having non-uniform transmissivity to X-rays such that the transmissivity of a first portion of said window disposed in the path of X-rays which traverse the shortest distance between said anode and an object to be examined is lower than the transmissivity of a second portion of said window disposed in the path of x-rays which traverse the longest distance between said anode and said object so that the X-ray radiation incident on said object is of generally uniform intensity.

2. The X-ray tube according to claim 1 including a shielding sleeve containing ferromagnetic material arranged between said cathode and said anode.

3. The X-ray tube according to claim 1 wherein said cathode is an indirectly heated storage cathode.

4. The X-ray tube according to claim 1 wherein said window comprises a plate disposed in said aperture and secured to said envelope in a vacuum-tight manner, said plate having a thicker portion defining said first portion of lower transmissivity and a thinner portion defining said second portion of higher transmissivity.

5. The X-ray tube according to claim 1 wherein said window comprises a first plate disposed in said aperture and secured to said envelope and a second plate of a surface area smaller than that of said first plate supported in said envelope in a superposed relationship with a portion of said first plate, said second plate and said last-named portion defining said first portion of said window having said lower transmissivity.

6. An X-ray tube comprising an envelope, a cathode and an anode arranged in a spaced apart relationship in said envelope such that electrons emitted by said cathode strike said anode to thereby generate a beam of X-rays, said envelope having an exit aperture for passing said beam to a region exterior of said envelope and a window arranged in said aperture, said window including a first plate disposed in said aperture and secured in a vacuum-tight manner to said envelope and a second plate of a surface area smaller than that of said first plate disposed adjacent said first plate and extending over a portion thereof nearest to the center of the area of said anode struck by said electrons emitted from said cathode.

7. The X-ray tube according to claim 6 wherein said second plate is disposed between said anode and said first plate.

8. The X-ray tube according to claim 7 wherein said first and second plates are made of beryllium.

9. The X-ray tube according to claim 8 wherein said first plate is a circular disc and said second plate is semicircular.

* * * * *